United States Patent [19]

Feess

[11] 3,973,329

[45] Aug. 10, 1976

[54] PROCESS AND DEVICE FOR DRYING SYNTHETIC FIBROUS MATERIAL

[75] Inventor: Erich Feess, Hofheim, Taunus, Germany

[73] Assignee: Hoechst Aktiengesellschaft, Frankfurt am Main, Germany

[22] Filed: Nov. 5, 1974

[21] Appl. No.: 521,205

[30] Foreign Application Priority Data

Nov. 7, 1973 Germany ..... 2355543

[52] U.S. Cl. ..... 34/9; 34/71; 34/95

[51] Int. Cl.[2] ..... F26B 3/00

[58] Field of Search ..... 34/9, 71, 95

[56] References Cited

UNITED STATES PATENTS

| | | | |
|---|---|---|---|
| 1,975,708 | 10/1934 | Bleiber | 34/9 |
| 2,207,278 | 7/1940 | Albrecht | 34/95 |
| 2,303,123 | 11/1942 | Johannessen | 34/9 |
| 3,405,453 | 10/1968 | Ries | 34/9 |
| 3,525,160 | 8/1970 | Dokoupil et al. | 34/95 |
| 3,854,220 | 12/1974 | Yamaguchi | 34/9 |

FOREIGN PATENTS OR APPLICATIONS

| | | |
|---|---|---|
| 141,307 | 5/1971 | Czechoslovakia |
| 433,173 | 1967 | Switzerland |

*Primary Examiner*—John J. Camby
*Attorney, Agent, or Firm*—Curtis, Morris & Safford

[57] ABSTRACT

A process for the drying of textile material, preferably made from hydrophobic fibers, which comprises bringing the textile material to be dried into contact with an absorbent material and, after the two materials have been separated, continuously squeezing off the absorbent material to regenerate its absorptivity, and a device for carrying out this process.

19 Claims, 3 Drawing Figures

PROCESS AND DEVICE FOR DRYING SYNTHETIC FIBROUS MATERIAL

Figure 1:
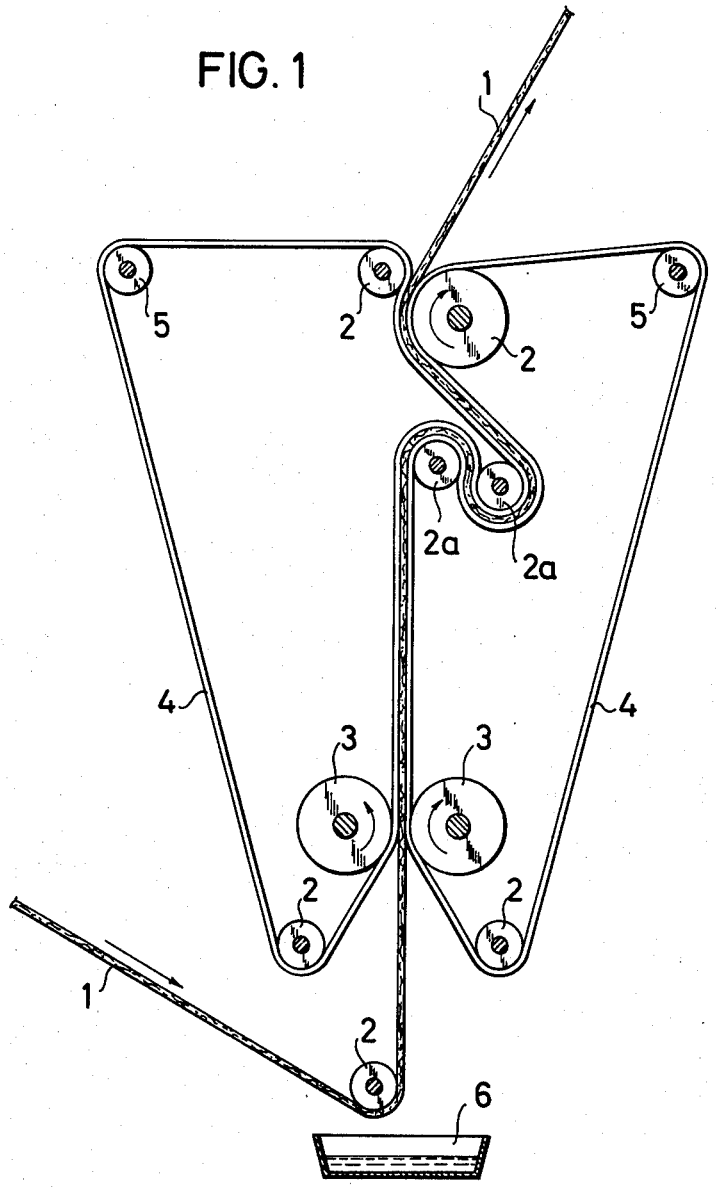

The present invention relates to a process and to a device for drying synthetic fibrous materials.

Textiles have hitherto been dried either by supplying heat or by means of a kind of freezing-out process. In both cases, energy is required. When heat is applied, the amount thereof has to be as large as to convert liquid from its liquid into its gaseous state, whereas, according to the freezing-out method, the liquid has to be brought from the liquid into the solid state of aggregation.

This invention provides a process for the drying of textile material made from hydrophobic fibers, which comprises bringing the textile material to be dried into contact with an absorbent material and, after the two materials have been separated, continuously squeezing off the absorbent material to regenerate its absorptivity.

The process of the invention is carried out by pressing the material to be dried onto the absorbent material by means of guiding rollers, thus forcing the water adhering to the individual fibers or meshes into the absorbent material.

The material to be dried remains in contact with the absorbent material over a length of at least 1 cm, usually from 2 cm to 3 m, the contact length may, however, also be at least 8 meters. Even when squeezing the material between rollers, high pressure need not be exerted onto the material to be dried, owing to the absorbent contact cloth. After the squeezing operation, the two materials are separated, and the contact material by now soaked with water has to be dehydrated before being able again to absorb water from further material to be dried. This adhering water is removed to a large extent either by drying the material or by simply squeezing it between two rollers. The again absorbent material, though still moist, is then returned to its initial position by means of reversing rollers.

The absorbent material consists of hydrophilic fibers, preferably of cotton or spun rayon, as well as of synthetic fibrous material with cellulose flocks or of fleeces. For supporting purposes, the absorbent material may also be transported on an endless backing cloth, which is optionally reinforced with metal inserts, and thus be stabilized.

This backing cloth, which may also be made of cellulose or even woolen fibers, may itself take over the function of an absorbent cloth. When such a backing cloth is used, only the absorbent material and not the backing cloth need be squeezed off or dehydrated. Such a backing cloth is especially advantageous if spun rayon is used as the absorbent material, since spun rayon has a reduced resistance to tearing when wet.

It has proved to be advantageous for the absorbent material — in the simplest case, a kind of back-grey cloth — to have the same width as, or even a little larger width than the rollers of the device have. This prevents shrinkage or other deformation or local wear of the rollers.

The drying effect may be improved by pressing an absorbent material from both sides onto the material to be dried.

The dehydration operation using dry cellulose contact cloth yields only insignificantly more favorable, lower values of residual moisture on the synthetic fibrous material than does dehydration using simply squeezed-off cellulose material which, prior to its contact with the synthetic fibrous material, still contains, for example, 70% of moisture. Thus, the residual moisture content on knit fabrics made of texturized polyester fibers is, in the one case, 20% and in the other case 22%, when, in the first case, dried velvet towelling and, in the latter case, moist, squeezed-off velvet towelling are used. The same degree of dehydration is reached by squeezing off the two materials together in a sandwich-type method as illustrated in FIG. 1 of the drawings.

The process of the invention is suitable for dehydrating textiles, preferably knit and woven fabrics made of extremely low-swelling, i.e. totally or predominantly hydrophobic or scarcely hydrophilic fibers, such as polyester, polyacrylonitrile or polyamide fibers.

The small amount of water remaining on the material to be dried may be removed by means of fans, if the degree of saturation of moisture in the ambient air is substantially below 100%, at best below 80%. Heat need not be applied, so that this method is very gentle and energy-saving. The residual amount of water may, however, also be removed by modern, migration-inhibiting methods, for example by high-frequency drying.

The device of the invention is illustrated diagrammatically by way of example in the accompanying drawings. In these drawings, FIG. 1 to 3 are cross-sectional views of three embodiments of the device of the invention.

In FIG. 1, the material to be dehydrated (1) is introduced from below over a deflecting roller (2) under moderate pressure into a highly efficient squeezing device consisting of two rollers (3). At the same time as the material, two endless absorbent webs (4) also enter the squeezing device from below via another deflecting roller each, positioned at either side of the material. After having passed over several deflecting roller (2 *a*), the now dehydrated material web is separated from the two absorbent webs, which are again returned into the squeezer by means of guiding rollers (5) which serve as tension rollers and controlling rollers against lateral deviation of the absorbent webs. These absorbent webs are dehydrated by means of squeezers. The resulting water is gathered in a gutter (6). A simplified embodiment of the device may also do without rollers (2*a*). The absorbent cloth may also be piled up prior to its repeated introduction into the squeezers in order to prolong the recovery time for the fibers between the repeated squeezing-off operations.

Figure 2:
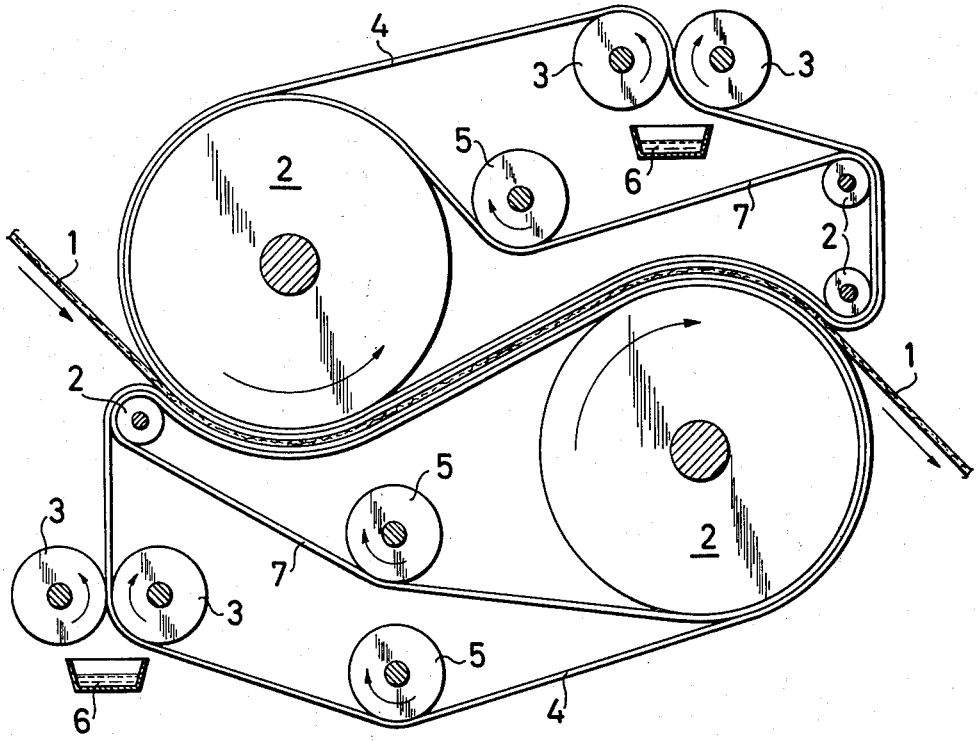
Figure 3:
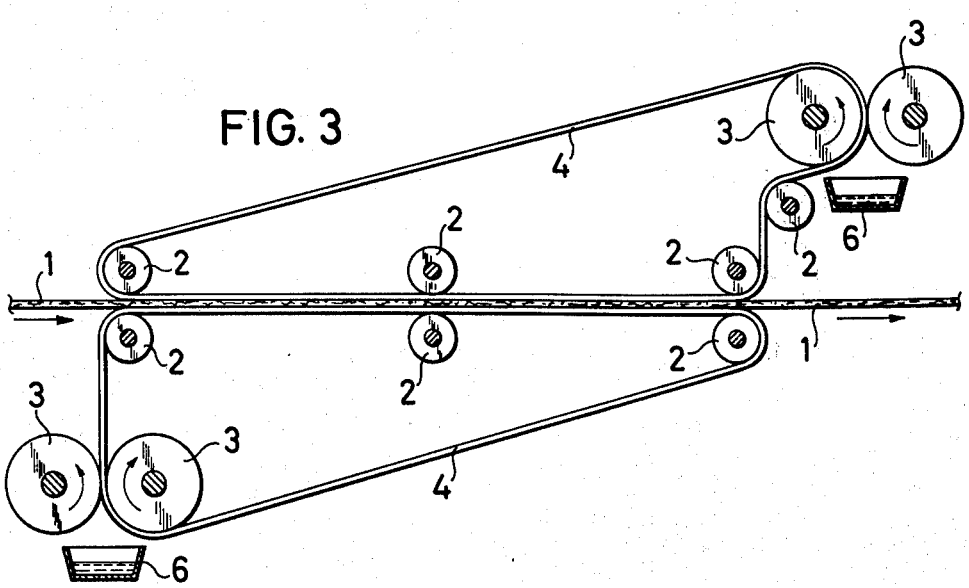

Further variants of a device according to the invention are illustrated in FIGS. 2 and 3. In FIG. 2, the textile web to be dried is passed together with two absorbent cloths over two cylinders, then dehydrated and each of the absorbent cloths is squeezed off by means of a separate squeezer. During the passage, the two absorbent cloths are supported during their contact with the textile web to be dried by a backing cloth (7). In FIG. 3, the textile web to be dried is dehydrated in horizontal position between two absorbent cloths.

The reference numbers given in FIGS. 2 and 3 have the same meanings as in FIG. 1.

An advantage of the process of the invention is that water is far more completely removed than with the conventional methods of squeezing-off or suctioning with air. Thus, for example, the water content of a knit fabric made from texturized polyester fibers — after having left the rollers of a conventional padding machine — is 80% of the weight of the fibers, whilst the water content of the same fabric treated according to the process of the invention amounts to only 20%. A very hard squeeze-off between rollers according to the conventional method moreover causes deformation and slipping in the fiber weave, thus reducing the bulk of the material and deteriorating its feel.

Another substantial advantage of this process over conventional drying methods using heat is a reduced energy consumption. Owing to the high evaporation heat of water, those methods using heat for drying require very high amounts of energy, whilst there is no change in the state of aggregation according to the invention, hence the amount of energy used is lower.

The following Examples illustrate the invention.

EXAMPLE 1

A large-size skein containing about 800 m of washed texturized polyester fiber material (weight 120 g per square meter) was entered into a drying device as illustrated in FIG. 1, seized by the endless absorbent cloth and taken along. The device was laid out so as to ensure a drying contact length between the absorbent cloth and the material to be dried of about 3.5 m and a transport speed of 40 m per minute. Hence, the dwelling time between the absorbent cloth was about 5 seconds. After the material had left the device and passed for about 3 meters in the air, it was completely dried when exposed to intensely agitated air, for example by means of suspended nozzles, at room temperature.

EXAMPLE 2

Washed knit fabric made of nylon was entered at open width into a device as illustrated in FIG. 1 between two cotton velvet webs, each joined and welded with nylon films at the initial butt ends to form an endless and seamless band. The fabric was squeezed off. While passing through the contact interval, the material may also be piled up in between. The remaining moisture was then removed in the usual manner by drying.

When a new fabric made of 70% of polyester and 30% of cotton fibers was dried on the same device, the residual moisture content was less than 35%.

I claim:

1. A process for drying a textile material which comprises continuously bringing a wet, predominantly hydrophobic textile material into contact with a predominantly hydrophilic absorbent material, drying the textile material, continuously squeezing off the absorbent material to remove water therefrom and regenerate its absorptivity and returning regenerated absorbent material to contact additional wet textile material.

2. The process of claim 1 wherein the absorbent material is a member selected from the group consisting of cotton, spun rayon, cellulose flock, fleece, velvet toweling and cotton velvet.

3. The process of claim 1 wherein the textile material consists predominantly of a member selected from the group consisting of polyester, polyacrylonitrile and polyamide material.

4. The process of claim 1 wherein the absorbent material is pressed onto the material to be dried.

5. The process of claim 1 wherein the textile material is brought into contact with the absorbent material at a rate of about 40 meters per minute.

6. The process of claim 1 wherein the textile material is pressed on and is maintained in contact with the absorbent material for about 5 seconds.

7. The process of claim 1 wherein the residual moisture content of the dried textile material is less than 35%.

8. The process of claim 1 wherein the regenerated absorbent material contains less than about 70% moisture.

9. A process for drying a wet, predominately hydrophobic textile material which comprises continuously bringing the wet textile material into contact with and maintaining it in contact with a regenerated absorbent material, drying the textile material, continuously squeezing off the absorbent material to remove water therefrom and regenerate its absorptivity, returning wet regenerated absorbent material containing less than about 70% moisture to contact additional wet textile material and removing dried textile material containing less than about 35% moisture.

10. The process of claim 9 wherein the absorbent material is simultaneously contacted with the textile material and squeezed off to regenerate its absorptivity.

11. The process of claim 9 wherein the absorbent material is contacted with the textile material to dry the textile material, is separated from the dried textile material and is then squeezed off to regenerate its absorptivity.

12. A process for drying a textile material which comprises continuously bringing a wet, predominantly hydrophobic textile material into contact with at least one endless belt predominantly hydrophilic absorbent material, simultaneously squeezing off the absorbent material to regenerate its absorptivity, removing squeezed off water, pressing the textile material onto the absorbent material and maintaining the textile material in contact with the absorbent material, drying the textile material, separating absorbent material from the textile material, removing dried textile material and returning the absorbent material to contact additional wet textile material.

13. A process for drying a textile material which comprises continuously bringing a wet, predominantly hydrophobic textile material into contact with two endless belt predominantly hydrophilic absorbent materials, simultaneously squeezing off the absorbent material to regenerate their absorptivity, removing squeezed off water, pressing the textile material between the two absorbent materials and maintaining the textile material in contact with the absorbent material, drying the textile material, separating the wet absorbents from the textile material, removing dried textile material and returning each of the absorbent materials to contact additional wet textile material.

14. An apparatus for the continuous drying of a wet, predominantly hydrophobic textile material comprising a means for introducing the textile material into the apparatus, cooperating means for pressing a predominantly hydrophilic absorbent material onto the textile material and for maintaining the textile material in contact with the absorbent material to dry said textile material, means operably connected to said apparatus for squeezing off said absorbent material to remove water therefrom, means mounted on said apparatus for separating absorbent material from the textile material and for returning absorbent material to contact additional wet textile material.

15. The apparatus of claim 14 wherein the cooperating pressing means and squeezing means are the same and simultaneously dry the textile material and squeeze off the absorbent material.

16. The apparatus of claim 14 wherein the means for squeezing off the absorbent material is operably connected to said apparatus and applied only to separated wet absorbent material.

17. The apparatus of claim 14 wherein there are two absorbent materials and means mounted on said apparatus are provided for pressing absorbent material from two sides onto the textile material.

18. An apparatus for the continuous drying of textile material comprising a means for introducing the textile material into the apparatus, cooperating means for pressing absorbent material from both sides onto the textile material and for maintaining the textile material in contact with the absorbent material to dry said textile material, said pressing means simultaneously drying said textile material and squeezing off said absorbent material to remove water therefrom, means operably connected to said apparatus to maintain said textile material in contact with said absorbents, means mounted on said apparatus for separating absorbent material from each side of the textile material and for returning each of the absorbent materials to contact additional wet textile material.

19. The apparatus of claim 18 wherein the textile material comprises a predominantly hydrophobic material and the absorbent comprises a predominantly hydrophilic material.

* * * * *